US006233877B1

(12) United States Patent
Monroe

(10) Patent No.: US 6,233,877 B1
(45) Date of Patent: May 22, 2001

(54) PORTABLE SAFETY ANCHOR

(76) Inventor: Sean Monroe, 5101 Westminster Pl., St. Louis, MO (US) 63108

( * ) Notice: Subject to any disclaimer, the term of this patent is extended or adjusted under 35 U.S.C. 154(b) by 0 days.

(21) Appl. No.: 09/489,536

(22) Filed: Jan. 21, 2000

Related U.S. Application Data

(63) Continuation-in-part of application No. 09/140,559, filed on Aug. 26, 1998, now abandoned.
(60) Provisional application No. 60/056,575, filed on Aug. 27, 1997.

(51) Int. Cl.[7] ..... E04G 3/08; E04G 25/04; A62B 35/00

(52) U.S. Cl. ..... 52/37; 52/632; 52/DIG. 12; 248/200.1; 248/208; 248/354.1; 248/354.3; 211/123; 211/206; 211/105.3; 49/55; 49/57; 182/57; 182/230

(58) Field of Search ..... 52/37, 127.2, 632, 52/DIG. 12; 248/57, 200.1, 208, 252, 354.1, 354.3, 354.4; 211/123, 124, 206, 105.3, 105.4, 105.5, 105.6; 410/145, 149, 151, 155; 49/55, 57; 160/112; 182/3, 4, 53, 57, 58, 59, 60, 61, 62, 230

(56) References Cited

U.S. PATENT DOCUMENTS

| | | | | |
|---|---|---|---|---|
| 217,091 | | 7/1879 | Gracey . | |
| 536,272 | | 3/1895 | Edsall . | |
| 596,722 | * | 1/1898 | Schneider | 248/200.1 |
| 698,223 | | 4/1902 | Prideaux . | |
| 743,462 | | 11/1903 | Curtis . | |
| 828,503 | * | 8/1906 | Powell | 248/252 |
| 953,197 | | 3/1910 | Fox . | |
| 1,023,650 | * | 4/1912 | Hovagimian | 211/105.6 |
| 1,275,053 | | 8/1918 | Leiding . | |
| 1,287,609 | | 12/1918 | Baptista . | |
| 1,328,579 | | 1/1920 | Manahan . | |
| 1,665,991 | | 4/1928 | Stramaglia . | |
| 1,723,970 | | 8/1929 | Jauch . | |
| 1,768,206 | | 6/1930 | Lemons et al. . | |
| 1,891,588 | | 12/1932 | Claus . | |
| 1,897,810 | | 2/1933 | Mallory et al. . | |
| 1,951,660 | | 3/1934 | Klaudt . | |
| 2,037,438 | | 4/1936 | Roth . | |
| 2,232,112 | * | 2/1941 | Hubbell et al. | 248/354.3 X |
| 2,474,434 | | 6/1949 | Mentz . | |
| 2,583,613 | | 1/1952 | Talbott . | |
| 2,833,248 | | 5/1958 | Meyer et al. . | |
| 2,934,319 | | 4/1960 | Wahlstrom . | |

(List continued on next page.)

FOREIGN PATENT DOCUMENTS

| | | |
|---|---|---|
| 128983 | 3/1902 | (DE) . |
| 251180 | 11/1987 | (DE) . |
| 435305 | 9/1935 | (GB) . |
| 2251020 | 6/1992 | (GB) . |

*Primary Examiner*—Laura A. Callo
(74) *Attorney, Agent, or Firm*—Grace J. Fishel

(57) ABSTRACT

A portable safety anchor for use in an aperture with side jambs such as a door or window as a tie off for a safety line. The anchor has a pair of clamps mounted on a bar longer than the aperture is wide. The clamps are T-shaped with a stem and a cross arm. The stem is adapted for contact with a first side of the wall and the cross arm has a toe and a heel. The toe is adapted for contact with the side jamb and the heel is adapted to extend beyond the side jamb on the first side of the wall. The heel has an aperture through which the bar passes. Means are provided for securing the clamps on the bar with the toes in frictional contact with the side jamb and the stem in frictional contact with the first side of the wall. A safety line is tied from the toe of one or both of the clamps such that a force applied to the safety line on the second side of the wall is transferred to the first side of the wall by the clamps.

7 Claims, 3 Drawing Sheets

U.S. PATENT DOCUMENTS

| | | | |
|---|---|---|---|
| 3,027,140 | | 3/1962 | Holzbach . |
| 3,327,983 | | 6/1967 | Snapp . |
| 3,880,394 | | 4/1975 | Wiscarver . |
| 4,304,078 | | 12/1981 | Meriwether, Jr. . |
| 4,378,071 | | 3/1983 | Yakimicki . |
| 4,633,612 | | 1/1987 | Forkish . |
| 5,092,504 | * | 3/1992 | Hannes et al. ..... 410/151 X |
| 5,346,036 | | 9/1994 | Arisman et al. . |
| 5,529,144 | | 6/1996 | Henderson . |
| 5,595,260 | | 1/1997 | Jalla . |
| 5,809,719 | | 9/1998 | Ashton et al. . |

* cited by examiner

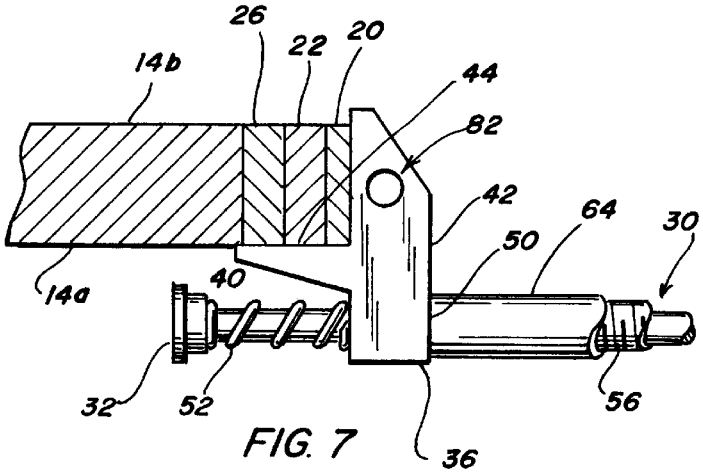
FIG. 7
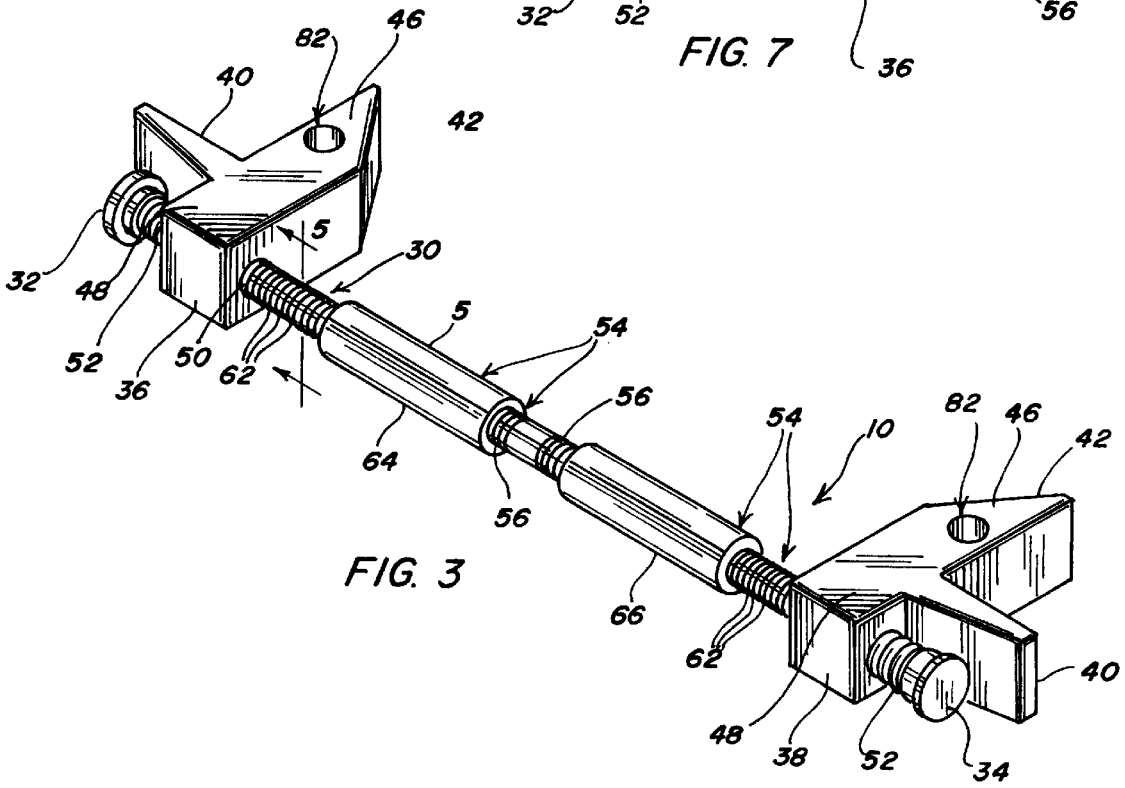
FIG. 3
FIG. 5A
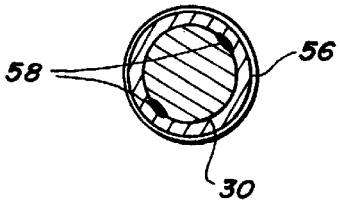
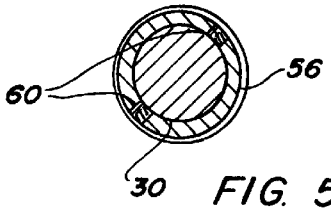
FIG. 5B

PORTABLE SAFETY ANCHOR

This application is a continuation-in-part of U.S. application Ser. No. 09/140,559, filed Aug. 26, 1998, now abandoned which application claimed priority from provisional application No. 60/056,575, filed Aug. 27, 1997.

BACKGROUND OF THE INVENTION

1. Field of the Invention

The present invention relates to a portable safety anchor for installation in a door or window as a tie off for a safety line.

2. Brief Description of the Prior Art

If there is a fire in a high rise building, it may be a necessary for fire fighters to establish an escape route through a window high above the ground. In a training module for this procedure, eye bolts attached to structural steel beams are provided as a tie off for a safety line. In a real fire, however, there are no preexisting eye bolts in which a rope or line can be attached and it is often difficult to find something that will serve as a solid tie off. It is to this need that the present invention is addressed. It will be understood, however, that the subject safety anchor is not limited to fire fighters and may be used by others or for attachment of construction equipment or the like.

BRIEF SUMMARY OF THE INVENTION

In view of the above, it is an object of the present invention to provide a portable safety anchor for use by fire fighters. It is another object to provide a portable safety anchor that can be used by others. Other objects and features of the invention will be in part apparent and in part pointed out hereinafter.

In accordance with the invention, a portable safety anchor is provided for use in an aperture in a wall, the wall having first and second sides and the aperture having a header jamb and side jambs. The anchor has a horizontal bar with first and second ends and a length longer than the distance between the side jambs. The bar has a first clamp at the first end and a second clamp at the second end. The first and second clamps are of opposite hand and movable along the bar. Each of the clamps is T-shaped with a first block forming a stem and a second block forming a cross arm. The first block has a face adapted for contact with the first side of the wall and the second block has a toe adapted for contact with the side jamb and a heel adapted to extend beyond the side jamb on the first side of the wall. The heel has an aperture through which the bar passes. A means is provided for securing the clamps on the bar with the toe of the second block of each clamp in frictional contact with the side jamb and the face of the first block in frictional contact with the first side of the wall. Another means is provided for attaching a safety line to the toe of the first or second clamp or to the toes of both clamps. The clamps serve as an attachment point for a safety line so that a force applied to the safety line on the second side of the wall is transferred to the first side of the wall by the first or second clamp or by both clamps. The portable safety anchor is preferably installed near the top or bottom of the aperture, the framing around the aperture being strongest there.

In one aspect of the invention, the means for attaching the safety line to the toe of the first or second clamp or to the toes of both clamps can be a hole in each toe. In a further aspect, a sleeve can be attached to the bar between the clamps with opposite ends of the sleeve externally threaded with threads of opposite hand and a first and second internally threaded sleeve can be threaded on the opposite ends of the externally threaded sleeve. In this instance the externally threaded sleeve and the internally threaded sleeves serve as the means for securing the clamps on the bar with the toes of the second block in frictional contact with the side jambs and the face of the first block in frictional contact with the first side of the wall.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which:

FIG. 1 is a side elevation showing a portable safety anchor in accordance with the present invention installed in a doorway or the like;

FIG. 3 is a perspective view of the anchor shown in FIG. 1 removed from the doorway or the like;

FIG. 5A is a cross-section taken along line 5—5 in FIG. 3;

FIG. 5B is a cross-section of a second embodiment taken along line 5—5 in FIG. 3;

DETAILED DESCRIPTION OF THE INVENTION

Figure 1:
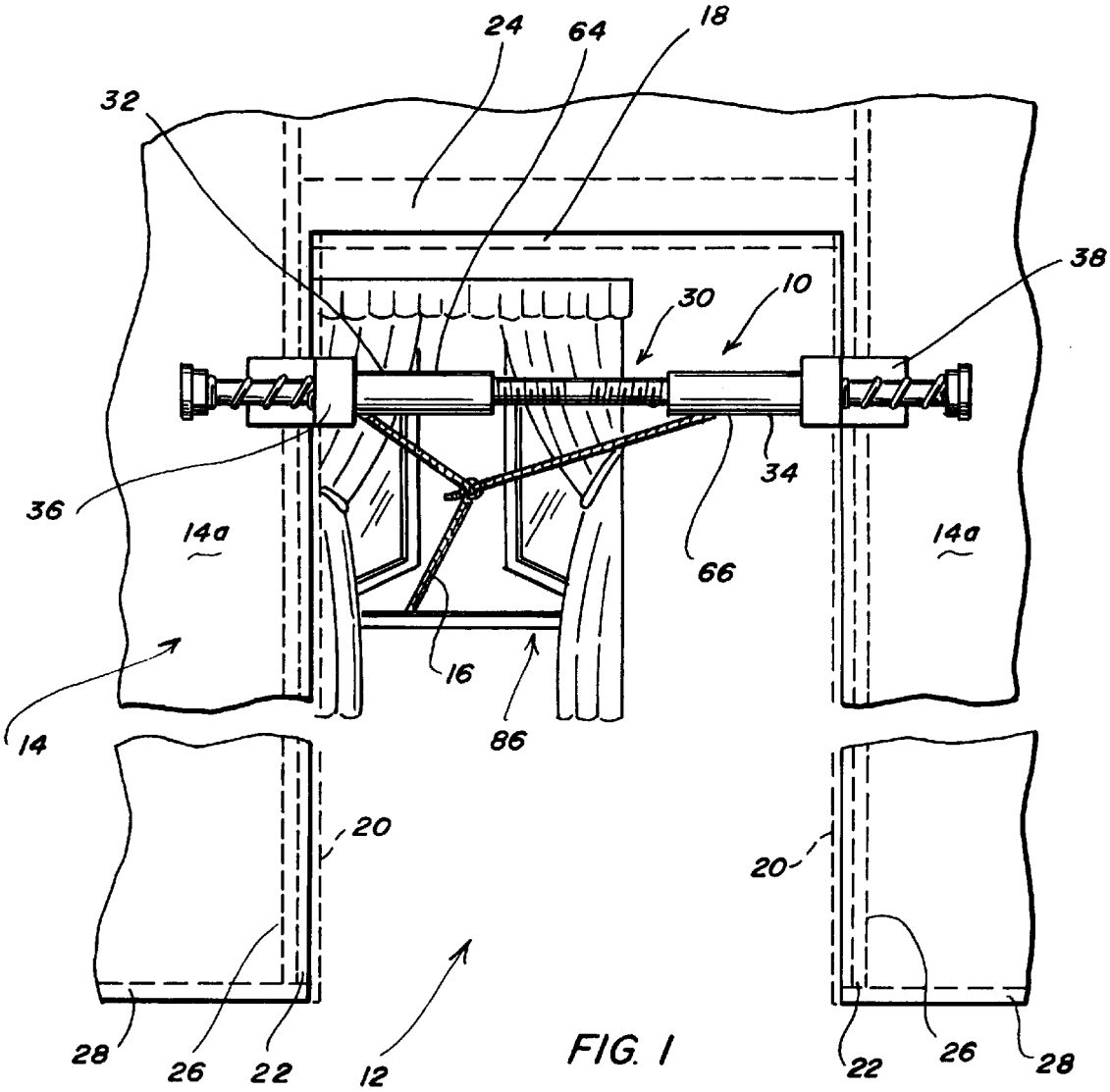

Referring to the drawings more particularly by reference character, reference numeral 10 refers to a portable safety anchor in accordance with the present invention. Anchor 10 is designed for use in an aperture 12 in a wall 14, such as a doorway or window. Wall 14 has first and second sides 14*a*, 14*b*, respectively, the second side being that side of the wall from which a safety line 16 extends. When aperture 12 includes a door or window, it has a frame with a header jamb 18 and side jambs 20 and, in many instances, trim on both sides of the wall.

As shown in FIG. 1, header jamb 18 and side jambs 20 are encased in framing, conventionally including a jack stud 22 on opposite sides of the aperture, upon which is mounted a header 24. The jack studs are flanked by king studs 26 which run floor to ceiling and are seated upon a sill 28. The framing about aperture 12 is strongest adjacent header 24 or sill 28. When aperture 12 is an arch or other opening without a casing for a door or window, header 24 and jack studs 22 function as header jamb 18 and side jambs 20 in the context of the present invention.

Figure 2:
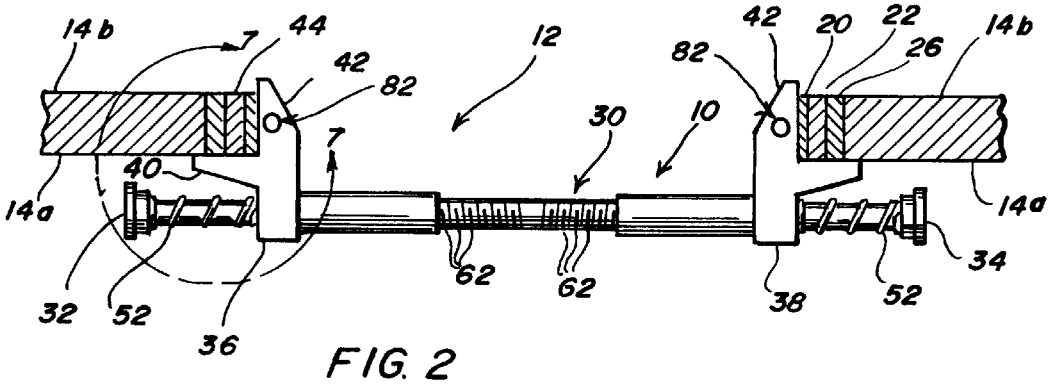
FIG. 2 is a top view of the anchor shown in FIG. 1.

Anchor 10, several embodiments of which are shown in the drawings, has a horizontal bar 30 with first and second ends 32, 34, respectively, and having a length longer than the distance between side jambs 20. Referring first to FIGS. 1–3, bar 30 has a first clamp 36 at first end 32 and a second clamp 38 at second end 34, said clamps being movable along bar 30 and identical except of opposite hand. Each of clamps 36, 38 is T-shaped with a first block 40 forming a stem and a second block 42 forming a cross arm. First block 40 has a face 44 adapted for contact with first side 14*a* of wall 14. Second block 42 has a toe 46 adapted for contact with side jamb 20 and a heel 48 adapted to extend beyond side jamb 20 on first side 14*a* of wall 14. Heel 48 has an aperture 50 through which bar 30 passes.

A resilient biasing means 52, such as a coil spring or the like, may be attached to each of clamps 36, 38 and to first and second ends 32, 34, respectively. As will be readily understood, each of resilient biasing means 52, shown in unstressed condition in FIG. 3, is placed under tension when clamps 36, 38 are inserted into aperture 12 as shown in FIGS. 1–2. Resilient biasing means 52 are selected such that the force exerted by them is sufficient to hold toes 46 of first and second blocks 40, 42 against side jambs 20 with sufficient force that anchor 10 does not slip under the force gravity.

A means 54 is provided for securing clamps 36, 38 on bar 30 in such manner that toe 46 of second block 42 of each clamp is in frictional contact with side jamb 20 and face 44 of first block 40 is in frictional contact with first side 14*a* of wall 14 when an external force is applied as more particularly described below. In the form shown in FIGS. 1–3, an externally threaded sleeve 56 is attached along a middle portion of bar 30. Sleeve 56 may be welded at 58 to bar 30 as shown in FIG. 5A, attached with set screws 60 as shown in FIG. 5B or the like, depending on the nature of the material selected for sleeve 56 and bar 30. Sleeve 56 may be one piece or sectioned with opposite ends externally threaded with threads 62 of opposite hand. If sleeve 56 is sectioned, the sections are preferably butted together to minimize the force on the joint between sleeve 56 and bar 30. First and second internally threaded nuts, illustrated as sleeves 64, 66, are threaded on the ends of sleeve 56. As shown in FIGS. 1–2, sleeves 64, 66 are tightened against clamps 36, 38 when anchor 10 is installed in aperture 12. In this embodiment, externally threaded sleeve 56 and internally threaded sleeves or nuts 64, 66 serve as means 54 for securing clamps 36, 38 to bar 30. In another embodiment, sleeve 56 may be eliminated and bar 30 threaded.

Figure 4:
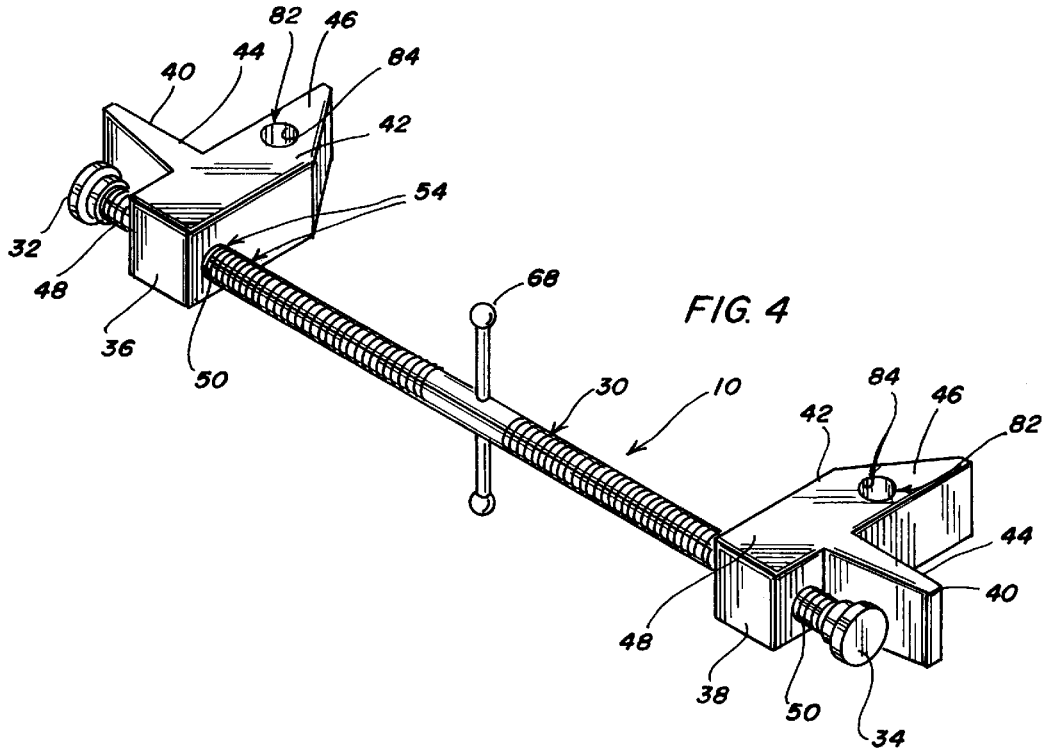
FIG. 4 is a perspective view of a second anchor in accordance with the present invention.
Figure 6:
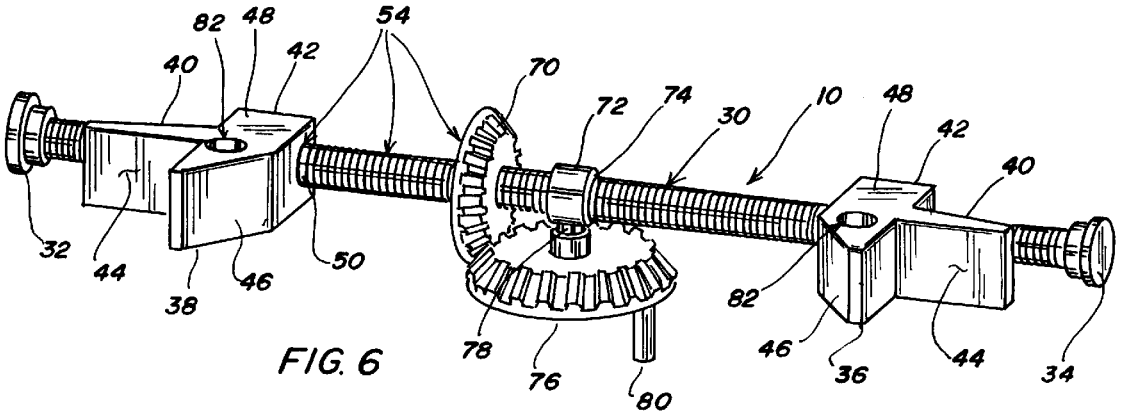
FIG. 6 shows an alternate way to adjust the effective length of the anchor shown in FIG. 4; and, FIG. 7 is a detail, on an enlarged scale, taken along line 7—7 in FIG. 2.

When anchor 10 is as shown in FIG. 4, apertures 50 in clamps 36, 38 are threaded with threads of opposite hand and bar 30 is threaded for threaded receipt in apertures 50. The spacing between clamps 36, 38 can be adjusted by rotating bar 30 and a handle 68 may be provided on bar 30 for leverage. Other mechanisms can be used to rotate bar 30, one of which is shown in FIG. 6. In these embodiments, threaded apertures 50 and threaded bar 30 serve as means 54 for securing clamps 36, 38 to bar 30.

As shown in FIG. 6, a bevel gear 70 is fixed to bar 30 such that bar 30 rotates with the gear. A spool 72, which is free to rotate on bar 30 is sandwiched between bevel gear 70 and a nut 74 which is also fixed to bar 30. A second bevel gear 76 in mesh with the first is suspended on a rod 78 attached to spool 72. A crank 80 is attached to second gear 76, which in turn rotates first gear 70 and bar 30. Second gear 76 is preferably larger in diameter than first gear 70 so that clamps 36, 38 can be adjusted with a few quick rotations of crank 80.

A means 82 for attaching safety line 16 to toe 46 of first or second clamp or to the toes of both clamps is provided. In simple form, means 82 is a hole 84 in each toe 46 through which a line may be passed and tied off. In other forms, means 82 may be an eye bolt or the like attached to toe 46, serving the same function. Toes 46 may be tapered towards side jambs 20 to minimize the mass of clamps 36, 38, making anchor 10 easier to carry and to suspend in aperture 12.

In use, anchor 10 is brought to aperture 12 with first and second clamps 36, 38 moved inward on bar 30 such that they slip between side jambs 20. When resilient biasing means are present, clamps 36, 38 are held in place on jambs 20 against the force of gravity by the tension on springs 52. Clamps 36, 38 are then tightened on bar 30 such that both of toes 46 are firmly pressed against side jambs 20 and each of faces 44 against first side 14*a* of wall 14. Of necessity, this operation must be accomplished very quickly. As shown in FIG. 1, it is preferred that anchor 10 be installed at the top of aperture 12 or at the bottom, the framing being strongest there.

Safety line 16 is attached to hole 84 in toe 46 of one or both of clamps 36, 38. As will be apparent, the force applied by safety line 16 is transferred to first side 14*a* of wall 14 by first or second clamp or through both clamps. Line 16 may be passed through a window 86 for attachment to a safety ladder providing an escape route for the occupants of the room or for attachment of such equipment as may be useful.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A portable safety anchor for use in an aperture in a wall, said wall having first and second sides and said aperture having a header jamb and side jambs, said anchor comprising a horizontal bar having first and second ends and having a length adapted to be longer than the distance between the side jambs, said bar having a first clamp at the first end and a second clamp at the second end, said first and second clamps being of opposite hand and movable along the bar, each of said clamps being T-shaped with a first block forming a stem and a second block forming a cross arm, said first block having a face adapted for contact with the first side of the wall, said second block having a toe adapted for contact with the side jamb and a heel adapted to extend beyond the side jamb on the first side of the wall, said heel having an aperture through which the bar passes, a means for securing the clamps on the bar with the toe of the second block of each clamp in frictional contact with the side jamb and the face of the first block in frictional contact with the first side of the wall and a means for attaching a safety line to the toe of the first or second clamp or to the toes of both clamps, whereby a force applied to the safety line on the second side of the wall is adapted to be transferred to the first side of the wall by the first or second clamp or by both clamps.

2. The anchor of claim 1 wherein the aperture in the heel of each clamp is threaded and the first and second ends of the bar are threaded with threads of opposite hand for threaded receipt in the apertures in the clamps, said threaded apertures and said threaded bar comprising the means for securing the clamps on the bar with the toes of the second block in frictional contact with the side jambs and the face of the first block in frictional contact with the first side of the wall.

3. A portable safety anchor for use in an aperture in a wall, said wall having first and second sides and said aperture having a header jamb and side jambs, said anchor comprising a horizontal bar having first and second ends and having a length adapted to be longer than the distance between the side jambs, said bar having a first clamp connected by a first resilient biasing means to the first end and a second clamp connected by a second resilient biasing means at the second end, said first and second clamps being of opposite hand and movable along the bar, each of said clamps being T-shaped with a first block forming a stem and a second block forming a cross arm, said first block having a face adapted for contact with the first side of the wall, said second block having a toe adapted for contact with the side jamb and a heel adapted to extend beyond the side jamb on the first side of the wall, said heel having an aperture through which the bar passes, a means for securing the clamps on the bar with the toe of the second block of each clamp in frictional contact with the side jamb and the face of the first block in frictional contact with the first side of the wall and a means for attaching a safety line to the toe of the first or second clamp or to the toes of both clamps, whereby a force applied to the safety line on the second side of the wall is adapted to be transferred to the first side of the wall by the first or second clamp or by both clamps.

4. The anchor of claim 3 wherein the resilient biasing means is a coil spring.

5. The anchor of claim 4 wherein the toe of each clamp is tapered and the means for attaching a safety line is a hole in the toe.

6. The anchor of claim 5 wherein the bar or a sleeve attached to the bar along a middle portion of the bar is threaded with threads of opposite hand upon which are threaded first and second internally threaded nuts, said threads of opposite hand and the nuts comprising the means for securing the clamps on the bar with the toes of the second block in frictional contact with the side jambs and the face of the first block in frictional contact with the first side of the wall.

7. The anchor of claim 5 wherein a sleeve is attached to the bar between the clamps and opposite ends of the sleeve are externally threaded with threads of opposite hand upon which are threaded first and second internally threaded sleeves, said externally threaded sleeve and internally threaded sleeves comprising the means for securing the clamps on the bar with the toes of the second block in frictional contact with the side jambs and the face of the first block in frictional contact with the first side of the wall.

* * * * *